US006319356B1

(12) United States Patent
Durkes et al.

(10) Patent No.: US 6,319,356 B1
(45) Date of Patent: Nov. 20, 2001

(54) PROCESS FOR CONTROLLING ODOR IN PAPER AND PAPERBOARD USING A HALOHYDANTOIN

(75) Inventors: Frank Durkes, Hünenberg; Walter Dubach, Buttwil, both of (CH)

(73) Assignee: Great Lakes Chemical Corporation, West Lafayette, IN (US)

( * ) Notice: Subject to any disclaimer, the term of this patent is extended or adjusted under 35 U.S.C. 154(b) by 0 days.

(21) Appl. No.: 09/310,622

(22) Filed: May 12, 1999

Related U.S. Application Data

(60) Provisional application No. 60/085,155, filed on May 12, 1998.

(51) Int. Cl.[7] ..... D21H 17/11; D21H 21/36; D21H 21/38

(52) U.S. Cl. ..... 162/5; 162/6; 162/74; 162/160; 162/161

(58) Field of Search ..... 162/161, 160, 162/24, 5, 6; 252/389.1, 187.33

(56) References Cited

U.S. PATENT DOCUMENTS

| | | | | |
|---|---|---|---|---|
| 3,328,294 | | 6/1967 | Self et al. | 210/62 |
| 3,951,731 | | 4/1976 | Jetzer | 162/5 |
| 4,855,296 | * | 8/1989 | Donofrio et al. | 162/161 |
| 5,942,153 | * | 8/1999 | Heydel | 252/187.33 |

OTHER PUBLICATIONS

Smook, Gary. *Handbook for Pulp & Paper Technologists*, 2[nd] Ed., pp. 36, 98, 127, 163–164, 169–172, 194–195, 207–208, 220–221, 228–229, 297. Vancouver: 1994.

Banni, S. et al. "A Novel Approach to Study Linoleic Acid Autoxidation: Importance of Simultaneous Detection of the Substrate and its Derivative Oxidation Products," *Free Radical Res.*, 1996, vol. 25, No. 1, pp. 43–53.

Yamamura, T. et al. "9H–Xanthene–2, 7–Diols as Antioxidants for Autoxidation of Lineolic Acid," *JAOCS*, vol. 72, No. 4 (1995) pp. 497–500.

Gassenmeier et al. "Formation of the Intense Flavor Compound *trans*–4, 5–epoxy–(E)–2–Decenal in Thermally Treated Fats," *JAOCS*, vol. 71, No. 12 (Dec. 1994) pp. 1315–1319.

Brimberg, U. "On the Kinetics of the Autoxidation of Fats," *JAOCS*, vol. 70, No. 3 (Mar. 1993) pp. 249–254.

Wang et al. "Inhibitions of the Autoxidation of Linoleic Acid by Flavonoids in Micelles," *Chemistry of Physics of Lipids*, vol. 63 (1992) pp. 37–40.

Cosgrove, J. et al. "The Kinetics of the Autoxidation of Polyunsaturated Fatty Acids," *Lipids*, vol. 22, No. 5 (1987) 299–304.

Grosch, W. et al. "Model Experiments About the Formation of Volatile Carbonyl Compounds From Fatty Acid Hydroperoxides," Flavour 87 (1981) pp. 433–448.

Table IV. *Influence of Ascorbic Acid on the Decompositoin of 9–HPOD and 9–HPOT to Aldehydes*, pp. 442–447.

Kanazawa, K., et al. "Stabilization of Linoleic Acid at the Process of the Autoxidation by Potassium Iodide," *Agr. Biol. Chem.*, vol. 39, No. 6 (1975) pp. 1177–1186.

Wiik, K., et al. "Studies on Odour Reduction in TCF Bleached Packaging Paper," paper presented at 84[th] Annual Meeting, Technical Section CPPA, pp. 1–4.

(List continued on next page.)

*Primary Examiner*—Steve Alvo
(74) *Attorney, Agent, or Firm*—Woodard, Emhardt, Naughton Moriarty & McNett

(57) ABSTRACT

A method of inhibiting the autooxidation of fatty acids in a paper product made from pulp fiber is accomplished by adding to the pulp fiber between about 1 mole/metric ton and about 25 moles/metric ton, preferably between about 2 moles/metric ton and about 10 moles/metric ton of an oxidizing halogen.

5 Claims, 1 Drawing Sheet

OTHER PUBLICATIONS

Wiik, K. et al. "Problems With Paper Odour—Possible Ways to Solve Them," Norwegian University of Science and Technology, Department of Chemical Engineering, N–7034 Trondheim, Norway. pp. 307–315.

Ziegleder, G. "Volatile and Odorous Compounds in Unprinted Paperboard," *Packaging Technology and Science*, vol. 11, pp. 231–239 (1998).

Wilken, R. and Kleebauer, M. "Status Of Components That Can Be Extracted Thermally From Paper In The Temperature Range From 80° C To 250° C And The Evaluation Of Their Problem Potential," Paper–Technological Grants, ISSN 0937–2091 (1996).

Guha, S.N. "Free Radical Reductive Degradation of *vic*–Dibromoalkanes and Reaction of Bromine Atoms with Polyunsaturated Fatty Acids: Possible Involvement of Br In the 1,2–Dibromoethane–Induced Lipid Peroxidation," *Arch. of Biochem. Biophys.*, 305(1), pp. 132–140, (1993).

Zheng, R. et al. "Inhibition of the autoxidation of linoleic acid by phenylpropanoid glycosides form Pedicularis in micelles," *Chem. Phys. Lipids*, 65(2), pp. 151–154, (1993).

Cillard, J. "Effect of experimental factors on the prooxidant behaviour of alpha–tocopherol," *J. Am. Oil Chem. Soc.*, 57(8), pp. 255–261, (1980).

Miyashita, K. et al. "Study on the oxidative rate and prooxidant activity of free fatty acids," *Am. Oil Chem. Soc.*, (63(10), pp. 1380–1384.

Takagi, T. et al. "Autoxidative rates of nonmethylene–interrupted polyenoic fatty acids," *J. Am. Oil Chem. Soc.*, 64(3), pp. 407–413, (1987).

Chudinova, V. et al. "Preparative separation and 1H NMR identification of products of linoleic acid autoxidation," *Bioord. Khim.*, 21(7), pp. 545–553 (Russian) 1995.

Ogawa, Hiroshi et al. "Autoxidative behaviour of unsaturated fatty acids in different molecular forms," *Yukagaku,*, 44(12) pp. 1055–9 (Japanese) 1995.

* cited by examiner

PROCESS FOR CONTROLLING ODOR IN PAPER AND PAPERBOARD USING A HALOHYDANTOIN

This Application claims the benefit of provisional application No. 60/085,155 filed May 12, 1998.

FIELD OF THE INVENTION

The present invention relates generally to processes for making paper, and more particularly to a process for making low-odor paper products.

BACKGROUND TO THE INVENTION

Paper and paperboard products have many uses in which it is important that the paper be free from odor and taste. For example, most consumer packaging, and especially food packaging, requires paper that is substantially free from unpleasant odors and tastes.

Unfortunately, conventional paper making processes provide ample opportunity for the paper to acquire odor. For example, odors may derive from the microbiological activity which is pervasive in pulp processing systems. Many of the additives used in paper manufacturing and finishing can also impart unpleasant odors to the paper, as can the degradation products of those additives. Additionally, the oxidation of unsaturated fatty acids (UFAs) is known to lead to the production of volatile organic compounds, which often have an unpleasant smell.

The practice of chlorine pulp bleaching, commonly using 30 to 50 kilograms of chlorine (expressed as $Cl_2$) per metric ton of paper produced, has long been used in the art to clean the pulp stock, and that bleaching has provided the additional benefit of controlling odors as well. Recently however, many paper and paperboard producers have become reluctant to practice chlorine bleaching—due largely to environmental reasons.

To replace the old bleaching technology, a variety of more environmentally friendly technologies have been developed. For example, microbiological activity can effectively be controlled using low levels of oxidizing biocide (typically 50–100 g/metric ton, expressed as $Cl_2$) in the thinstock cycles and water recycling systems where the activity is most problematic. Proper additive selection is generally the best way to mitigate odors associated with additives, although low levels of biocides are occasionally used to minimize additive odors as well.

Unfortunately however, the volatile organic compounds produced from the degradation of unsaturated fatty acids cannot be controlled using these techniques. The oxidative degradation of these organic compounds occurs gradually over time, including during storage of finished products, and the addition of low levels of biocide as described above does not prevent that degradation. A need therefore exists for a method of controlling the production of volatile organic compounds, particularly those that arise from the breakdown of unsaturated fatty acids.

As further background to the invention, it is known that resins present in wood are the primary source of UFA in the finished paper or paperboard. Some additives, such as anti-foaming agents, may also contribute UFAs to a lesser extent.

Linoleic acid is the most prevalent UFA in wood resins, followed by oleic acid and linolenic acid. These UFAs oxidize naturally over time, and the autooxidation of these compounds yields volatile compounds with unpleasant odors or tastes. Hexanal is perhaps the most common of these breakdown products.

It is believed that the UFA autooxidation proceeds by a free radical mechanism, possibly catalyzed by metals. For this reason, it has been proposed that chelants may help reduce the rate of UFA autooxidation. Unfortunately, the practical aspects of that approach have not yet been established.

Much of the UFA present in pulp is associated with the fiber, making rigorous pulp washing one method for removing UFAs. Fiber washing requires large quantities of fresh water however, increasing production costs and making this approach impractical for large-scale commercial applications.

Anti-oxidants, such as BHT and BHA, can sometimes be used to reduce the rate of auto-oxidation in foods. Here too though, the practical aspects of this approach in commercial production processes have not yet been determined.

In view of the above, it can be seen that a need currently exists for a method of preventing the breakdown of unsaturated fatty acids in paper and paperboard products, thereby controlling the resulting odors. The present invention addresses that need.

SUMMARY OF THE INVENTION

Briefly describing one aspect of the present invention, there is provided a method of inhibiting the autooxidation of unsaturated fatty acids in a paper product made from pulp fiber. The preferred method comprises adding to the pulp fiber between about 2 mol/metric ton and about 10 mol/metric ton of an oxidizing halogen.

One object of the present invention is to provide a process for controlling odors caused by the autooxidation of unsaturated fatty acids in paper products.

Further objects and advantages of the present invention will be apparent from the following description.

DESCRIPTION OF THE PREFERRED EMBODIMENT

Figure 1:
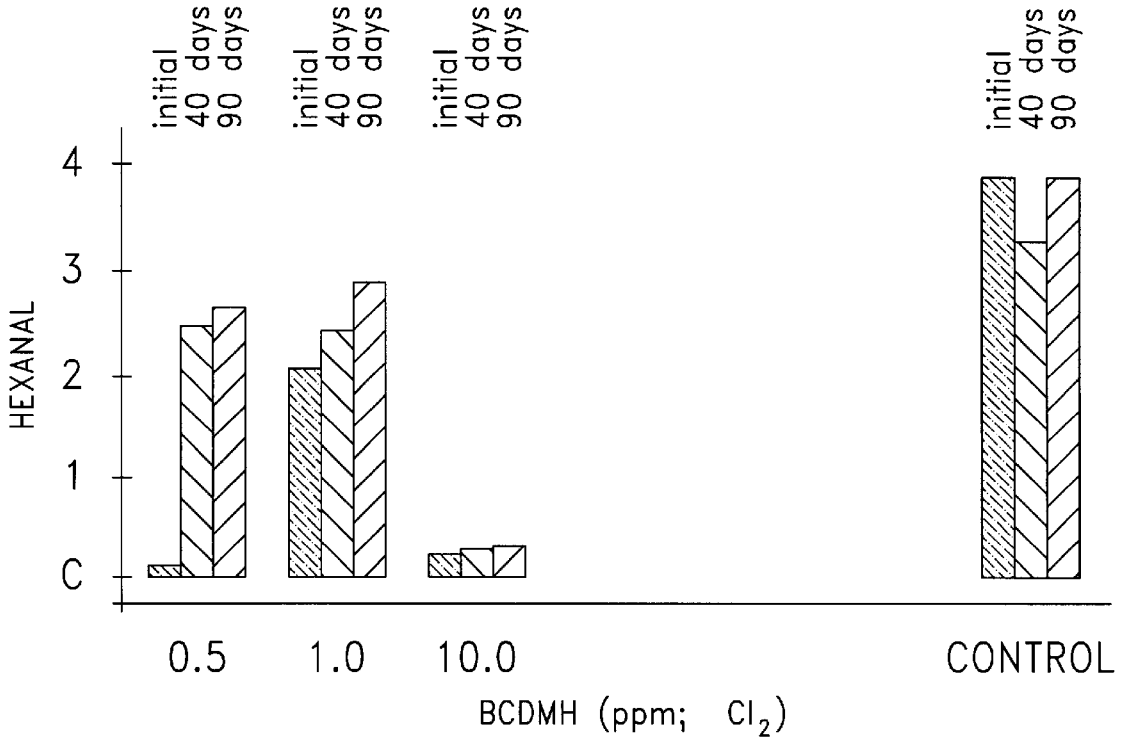
FIG. 1 is a bar graph of hexanal formation, including samples treated with BCDMH.

For the purpose of promoting an understanding of the principles of the invention, reference will now be made to preferred embodiments and specific language will be used to describe the same. It will nevertheless be understood that no limitation of the scope of the invention is thereby intended, such alterations and further modifications in the described embodiments, and such further applications of the principles of the invention as described herein, being contemplated as would normally occur to one skilled in the art to which the invention pertains.

The present invention provides for methods to reduce the source of objectionable odors in paper and paperboard by oxidizing unsaturated alkyl moieties present in the pulp during the paper manufacturing process. The methods involve the addition of a halogen donor source to the pulp in a concentration sufficient to react with unsaturated alkyl moieties to prevent their degradation to low odor threshold compounds such as volatile aldehydes, alcohols and acids. Effective oxidizing halogen application rates are typically between about 0.10 to 0.70 kilograms of additive (expressed as $Cl_2$ equivalents) per metric ton of paper or paperboard produced. This compares with chlorine pulp bleaching where common halogen application rates are 30 to 50 kilograms (expressed as $Cl_2$ equivalents) per metric ton of paper or paperboard produced. This represents an approximate 99% reduction of applied halogen.

It is well known that unsaturated alkyl moieties are found in various biomolecules present in most sources of pulp used in the manufacture of paper, including for example, fatty acids, fatty alcohols and lipids. All of these moieties are susceptible to autooxidation and can lead to volatile, odiferous degradation products, as for example, $C_1$–$C_{10}$ aldehydes, alcohols and acids. Though the following description focuses on reducing the autooxidation of unsaturated fatty acids (UFAs) believed to be the dominant source of objectionable odors in paper, the present inventive processes are equally applicable for the reduction of odors derived from the oxidation of other unsaturated alkyl containing biomolecules in a given pulp source. The reduction of all such autooxidations is contemplated within the scope of the present inventive processes.

The halogen donors of the present invention may be any source of oxidizing halogen. Such oxidizing halogens are in the +1 oxidation state and when hydrolyzed will exist as the hypohalous acid or hypohalite anion. Such halogen compounds include, but are not limited to, the halohydantoins, haloisocyanuric acids, haloamines, and halosulfamates, as well as alkali metal or alkaline earth hypochlorites and elemental chlorine or bromine, such as $Cl_2$ or $Br_2$. Other halogen donors include hypobromous acid and hypobromite such as is generated by the addition of BrCl, or from the reaction of NaBr with $Cl_2$, NaOCl or $O_3$.

In one preferred embodiment the halogen donor is characterized by having the halogen bonded to a nitrogen moiety. It is advantageous for the donor to have a nitrogen-halogen bond strong enough to minimize unproductive side reactions yet sufficiently labile to oxidize UFAs in the pulp. Donors with more reactive halogen moieties will require higher concentrations for effective reduction of odors because they will be consumed in reactions with numerous other components in the pulp in addition to the desired UFAs. Unproductive side reactions for purposes of the present invention include consumption by demand reactions, such as decoloration (i.e. bleaching) and reaction with starches, synthetic sizing agents and excess bleaching agents such as sulfite and peroxide. Other unproductive side reactions include wasteful reactions with other additives such as halogenation of polyamines added as strength and drainage aids and deposit control agents.

In another preferred embodiment the halogen donor is a halohydantoin such as mono or dihalodialkylhydantoin and derivatives thereof Preferred examples include bromochlorodimethylhydantoin, dibromodimethylhydantoin, dichlorodimethylhydantoin, monobromodimethylhydantoin, monochlorodimethylhydantoin, bromochloromethylethylhydantoin, dibromomethylethylhydantoin, dichloromethylethylhydantoin, monobromomethylethylhydantoin and monochloromethylethylhydantoin. Halohydantoin derivatives having other alkyl groups are envisioned within the present invention but are not presently commercially available. Likewise, polymers and other compounds containing one or more halohydantoin moieties are contemplated within the scope of the present invention, but are not presently economically preferred.

In certain preferred embodiments the halogen donor is added to the pulp material in an amount and for a time sufficient to oxidize UFAs in the pulp material prior to the paper formation stage of manufacture. The halogen donor may be added at any stage of the paper stock preparation process, however the amounts and contact time required to effect the reduction of odor producing autooxidation products will greatly vary depending on the stage of the addition. Early in the paper stock preparation process, depending on the specific techniques used, virgin or recycled fiber may be subjected to bleaching, de-inking, removal of coatings and solid wastes, which techniques may use large quantities of halogen reactive compounds which will unnecessarily consume halogen donor in competing unproductive side reactions.

In addition, washing steps may remove significant quantities of unsaturated alkyl containing compounds, which therefore do not require oxidation by the halogen donor for reduction of odor in the final product. Furthermore, if the halogen donor is added too early in the manufacturing process, washes may remove the halogen donor before its effective use in the process of this invention. In many cases, it is therefore preferred to add the halogen donor in the final stages of thick stock preparation to minimize the amount of halogen donor required for oxidation of UFAs in the pulp.

Likewise, adding the halogen donor too late in the paper manufacturing process may prove less efficient due to dilution of the fiber. As dilution water is added to form the thin stock, the concentration of alkenyl groups decreases and the residence time of the stock before the paper formation stage decreases. The effects on the kinetics and completion of the oxidation reaction due to this dilution and residence time reduction would have to be compensated by increasing the concentration of halogen donor to achieve the same degree of UFA oxidation and therefore odor control.

The amount of halogen donor to be added to the pulp is preferably an amount sufficient to oxidize the double bonds in alkenyl moieties in the pulp. Particularly, the amount of halogen donor is preferably sufficient to oxidize the double bonds present in the fatty acids, fatty alcohols and lipids in the pulp. The amount of halogen donor is measured by the molar content of oxidizing halogen in the donor molecule able to oxidize alkenyl groups (i.e. the moles of halogen atoms in the +1 oxidation state). The amount of halogen should be sufficient to oxidize the alkenyl groups over and above the amount of halogen consumed in unproductive side reactions. Increased amounts of donor will be necessary in pulps containing substantial levels of residual bleaching agents, starches and other oxidizable components that are at least as reactive with the halogen donor as the target alkenyl groups.

In a preferred embodiment, halogen donor is added to the pulp at between about 1 and about 25 moles of oxidizing halogen per metric ton of fiber. In another embodiment, the halogen donor is added at between about 2 and about 10 moles of oxidizing halogen per metric ton of fiber. In yet another embodiment, halogen donor is added at between about 2 and about 5 moles of oxidizing halogen per metric ton of fiber.

Several halogen donors useful in the present invention have been known in the art as biocides in water recirculation systems such as those used in paper manufacturing processes. Typical concentrations of these halogen sources when used as biocides are between about 0.5 and 5.0 ppm, which is below the concentrations necessary for effective oxidation of UFAs and therefore for effective reduction of odors in the resulting paper.

It is likewise known that several of the halogen donors useful in the present invention are capable of bleaching activity if present at sufficiently high concentrations. Typical concentrations necessary for bleaching are on the order of about 400–700 moles of halogen per metric ton of fiber. This is in considerable excess of the amount necessary for the reduction of odors in the final product paper in accordance with the present invention. Furthermore, preferred halogen donors of the present invention are not economically favored as bleaching agents and are therefore not acknowledged as typical bleaching agents in the industry. Conversely, typical halogen containing bleaching agents are not preferred halogen donors in the present invention due to their greater halogen lability and consequent higher level of unproductive competing side reactions.

Reference will now be made to specific examples using the processes described above. It is to be understood that the examples are provided to more completely describe preferred embodiments, and that no limitation to the scope of the invention is intended thereby.

EXAMPLE 1

Stabilization of linoleic acid methyl ester by bromochlorodimethylhydantoin.

One milliliter samples of 10 mg/mL linoleic acid methyl ester (LME) were treated for two hours with bromochlorodimethylhydantoin (BCDMH) at 0, 10 or 30 mg per sample. The samples were applied to filter paper and sealed in glass containers for 4 or 7 days at 30° C. The hexanal content of the headspace vapor was then measured as an indicator of lipid oxidation.

Table 1 shows that BCDMH significantly suppressed the autooxidation of LME to hexanal under these conditions.

TABLE 1

Stabilization of linoleic acid methyl ester by bromochlorodimethylhydantoin.

| Sample | Hexanal after 4 Days (Counts) | Hexanal after 7 Days (Counts) |
|---|---|---|
| Filter Paper Alone | None Detected | None Detected |
| +10 mg LME | 739 | 1814 |
| +10 mg LME + 10 mg BCDMH | 95 | 318 |
| +10 mg LME + 30 mg BCDMH | 91 | 86 |

EXAMPLE 2

Reduction of Hexanal Formation by Bromochlorodimethylhydantoin

Samples of fresh sulfite cellulose were suspended at 1% by weight solids in water. Bromochlorodimethylhydantoin (BCDMH) was added to the water at levels calculated to yield 0.5, 1.0 and 10 mg of oxidizing halogen per liter, expressed as $Cl_2$. This is equivalent to 85, 170, and 1700 grams of BCDMH per metric ton of fiber (0.7, 1.4, and 14 moles of oxidizing halogen per metric ton of fiber). The samples were vacuum filtered to form sample papers that were sealed and stored for up to 90 days. The headspace vapor was then analyzed for hexanal content by standard methods.

The results shown in FIG. 1 demonstrate significant reduction of hexanal formation from. auto-oxidation for samples treated with BCDMH.

EXAMPLE 3

Reduction of Hexanal Formation in the Manufacture of Paper Board

Paperboard was manufactured by an art recognized process that includes pulping, preparation of a thick stock that is between about 2% and about 18% solids (preferably between 2.5% and 10%), and dilution of the stock to ≦1% fiber in the headbox before paper formation. BCDMH was mixed into the pulp during the preparation of the paper stock, prior to the stock entering the approach system, at the rate of 250 grams per metric ton of fiber (2.1 moles of oxidizing halogen per metric ton of fiber). Samples of finished paper were sealed and stored for 90 days. The samples were then analyzed for hexanal content.

The introduction of BCDMH significantly reduced haxanal levels. In particular, hexanal content ranged between about 0.9 to about 10 mg hexanal/$m^2$ of paper board (with approx. 40% of the data points being above 4 mg/$M^2$) without BCDMH, and about 0.6 to about 2.5 mg/$M^2$ (for 80% of the data points, with values of about 2.5 to about 5 mg/m2 for the remaining data points) when BCDMH was used.

EXAMPLE 4

Reduction of Objectionable Odors in Finished Paper Board By the Use of Chloroisocyanuric Acid in the Preparation of the Paper Stock During Manufacture Paperboard is manufactured by an art-recognized process that includes pulping, preparation of a thick stock that is between about 2% and about 18% solids (preferably between 2.5% and 10%), and dilution of the stock to ≦1% fiber in the headbox before paper formation. Chloroisocyanuric acid is then mixed into the pulp during the preparation of the paper stock, prior to the stock entering the approach system, at the rate of between 2 to 10 moles halogen per metric ton of fiber. Samples of finished paper are sealed and stored for 90 days. The samples are then analyzed for hexanal content as an indicator of objectionable odor producing autooxidation.

Samples of paper produced with chloroisocyanuric acid have reduced levels of hexanal compared to samples produced without the chloroisocyanuric acid treatment. In particular, only 20%–60% of the hexanal that is produced in untreated samples is generally produced in samples that are treated with 2 to 10 moles oxidizing halogen (per metric ton of fiber) from chloroisocyanuric acid.

EXAMPLE 5

Reduction of Objectionable Odors in Finished Paper Board By the Use of chloramine in the Preparation of the Paper Stock During Manufacture Paperboard is manufactured by pulping and preparing a thick stock that is between about 2% and about 18% solids (preferably between 2.5% and 10%), and dilution of the stock to ≦1% fiber in the headbox before paper formation. Chloramine is mixed into the pulp during the preparation of the paper stock, prior to the stock entering the approach system, at the rate of between 2 to 10 moles halogen per metric ton of fiber. Samples of finished paper are sealed and stored for 90 days. The samples are then analyzed for hexanal content as an indicator of objectionable odor producing autooxidation.

Samples of paper produced with chloramine have reduced levels of hexanal compared to samples produced without the chloramine treatment. In particular, only 20%–60% of the hexanal that is produced in untreated samples is produced in samples that are treated with 2 to 10 moles oxidizing halogen (per metric ton of fiber) from chloramine.

EXAMPLE 6

Reduction of Objectionable Odors in Finished Paper Board By the Use of Chlorosulfamate in the Preparation of the Paper Stock During Manufacture Paperboard is manufactured by the process described in the previous examples, except that chlorosulfamate is mixed into the pulp during the preparation of the paper stock, prior to the stock entering the approach system, at the rate of between 2 to 10 moles halogen per metric ton of fiber. Samples of finished paper are sealed and stored for 90 days. The samples are then analyzed for hexanal content as an indicator of objectionable odor producing autooxidation.

Samples of paper produced with chlorosulfamate have reduced levels of hexanal compared to samples produced without the chlorosulfamate treatment. In particular, only about 20%–60% of the hexanal that is produced in untreated samples is produced in samples that are treated with 2 to 10 moles oxidizing halogen (per metric ton of fiber) from chlorosulfamate.

EXAMPLE 7

Reduction of Objectionable Odors in Finished Paper Board By the Use of Bromamine in the Preparation of the Paper Stock During Manufacture Paperboard is manufactured by the process of the previous examples, except bromamine (for example, monoethanolamine hydroperbromide) is mixed into the pulp during the preparation of the paper stock prior to the stock entering the approach system. The bromamine is added at the rate of between 2 to 10 moles halogen per metric ton of fiber. Samples of finished paper are sealed and stored for 90 days. The samples are then analyzed for hexanal content as an indicator of objectionable odor producing autooxidation.

Samples of paper produced with chloramine have reduced levels of hexanal compared to samples produced without the bromamine treatment. In particular, only 20%–60% of the hexanal that is produced in untreated samples is produced in samples that are treated with 2 to 10 moles oxidizing halogen (per metric ton of fiber) from bromamine.

EXAMPLE 8

Reduction of Objectionable Odors in Finished Paper Board By the Use of Bromosulfamate in the Preparation of the Paper Stock During Manufacture Paperboard is manufactured by the process of the previous examples, except bromosulfamate is mixed into the pulp during the preparation of the paper stock, prior to the stock entering the approach system, at the rate of between 2 to 10 moles halogen per metric ton of fiber. Samples of finished paper are sealed and stored for 90 days. The samples are then analyzed for hexanal content as an indicator of objectionable odor producing autooxidation.

Samples of paper produced with bromosulfamate have reduced levels of hexanal compared to samples produced without the bromosulfamate treatment. In particular, only about 20%–60% of the hexanal that is produced in untreated samples is produced in samples that are treated with 2 to 10 moles oxidizing halogen (per metric ton of fiber) from bromosulfamate.

While the invention has been illustrated and described in detail in the drawing and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of inhibiting the autoxidation of unsaturated fatty acids in a paper product made from pulp fiber, said method comprising contacting unsaturated fatty acids in the pulp fiber with a halohydantoin, wherein said contacting comprises adding to the pulp fiber between about 2 moles/metric ton and about 10 moles/metric; ton of a halohydantoin.

2. A method according to claim 1 wherein said halohydantoin comprises bromochlorodimethylhydantoin.

3. A method according to claim 1 wherein between about 2 moles/metric ton and about 5 moles/metric ton of a halohydantoin halogen is added to the pulp fiber.

4. A method according to claim 1 wherein said halohydantoin is added to the pulp fiber when said pulp fiber is in a thick stock of at least about 2% pulp fiber.

5. A method of inhibiting the autoxidation of fatty acids in a paper product made from pulp fiber, said method comprising contacting unsaturated fatty acids in the pulp fiber with a halohydantoin, wherein said contacting comprises adding between about 1 mole/metic ton and about 25 moles/metric ton of a halohydantoin to a thick stock of at least about 2% pulp fiber.

* * * * *